United States Patent [19]

Wier

[11] Patent Number: 4,622,727

[45] Date of Patent: Nov. 18, 1986

[54] BUCKLE FOR A SAFETY BELT

[75] Inventor: Franz Wier, Goggingen, Fed. Rep. of Germany

[73] Assignee: TRW Repa GmbH, Alfdorf, Fed. Rep. of Germany

[21] Appl. No.: 644,049

[22] Filed: Aug. 24, 1984

[30] Foreign Application Priority Data

Aug. 31, 1983 [DE] Fed. Rep. of Germany ..... 3331453

[51] Int. Cl.[4] ..... A44B 11/26

[52] U.S. Cl. ..... 24/642; 24/641

[58] Field of Search ..... 24/633, 639, 642

[56] References Cited

U.S. PATENT DOCUMENTS

| | | | |
|---|---|---|---|
| 4,197,619 | 4/1980 | Burleigh | 24/642 |
| 4,228,567 | 10/1980 | Ikesue et al. | 24/642 |
| 4,392,282 | 7/1983 | Wier | 24/642 |
| 4,545,097 | 10/1985 | Wier . | |

FOREIGN PATENT DOCUMENTS

| | | | |
|---|---|---|---|
| 3004150 | 8/1981 | Fed. Rep. of Germany | 24/642 |
| 3027009 | 2/1982 | Fed. Rep. of Germany | 24/642 |
| 2377780 | 8/1978 | France | 24/642 |
| 2083542 | 3/1982 | United Kingdom | 24/642 |

*Primary Examiner*—Peter A. Aschenbrenner

*Attorney, Agent, or Firm*—Yount & Tarolli

[57] ABSTRACT

A buckle fastener for a safety belt including a housing having a guiding channel for guiding a tongue into and from the housing, a latching member movable transversely to the insertion channel for selective engagement and disengagement with a recess formed in the tongue, a leaf spring member biasing the latching member into engagement with the recess in the tongue, and a pressure key slidably guided in the housing in a direction parallel to the guiding channel. The pressure key is provided with ramp means engaging the latching member for pushing the latching member out of engagement with the recess in the tongue when said pressure key is depressed. The leaf spring has one end secured to said pressure key and its opposed free end bearing on the latching member. The leaf spring moves simultaneously with the pressure key when it is depressed. An abutment member is connected with the housing and has an edge extending transversely relative to said leaf spring and is positioned in such a manner in relative to said leaf spring that, upon partial depression of said pressure key, an intermediate portion of said leaf spring abuts against the edge and upon further depression of said pressure key the free end of said leaf spring is lifted off the latching member.

6 Claims, 9 Drawing Figures

BUCKLE FOR A SAFETY BELT

The invention relates to a buckle for a safety belt.

In known safety belt buckles, the latch bar, movable transverse to the insertion path, is constantly under the force of a spring, which presses, or seeks to press the bar into the locking or closing position. For the opening of the belt buckle, thus, for the unlocking of the insertion tongue, the pressure element, preferably designed as a pressure key, is moved along an unlocking path, this pressure element beng connected, for example, by means of a pressure edge running diagonal, with the latch bar, and lifting the latter into the unlocking position until it is outside the insertion path for the insertion tongue. This actuation of the pressure element is made difficult by friction forces between the pressure element and the latch bar, and additionally by the spring forces constantly acting on the bar, which must be additionally overcome manually in order to bring the pressure element into the opening position. In this way, through the said spring force, the friction, and thus the wear, is considerably increased.

The invention attacks the problem of designing a belt lock, so that the actuation of the pressure element is facilitated the wear caused by friction reduced.

With the present invention, during the actuation of the pressure element, preferably designed as a pressure key, the spring runs up on the run-up (transition) edge and, in this way, is raised more or less from the bar; that is, the pressure force of the spring is changed during the stroke of the pressure element, up to complete relief after lifting off the spring. This gives the advantage that with the actuation of the pressure element, the spring force, acting at first on the bar, is reduced and then fully eliminated, so that the pushing of the pressure key, for example, encounters practically no friction forces, which might make the pushing movement difficult and cause a relatively high wear.

Preferably the spring runs, bent in sickle form, over the run-up (transition) edge. In this way the forces needed to lift the spring are reduced to a minimum. Preferably the run-up edge consists, here, of a material, plastic, for example, which has a lower friction coefficient than the spring material.

Other advantageous embodiments of the invention are given from the example of execution shown in the drawing and described below.

FIGS. *3a, 3b* to *5a, 5b,* show the belt lock according to the preceding figures, in each case in top view and side section, and in three different positions of actuation.

Figure 1:
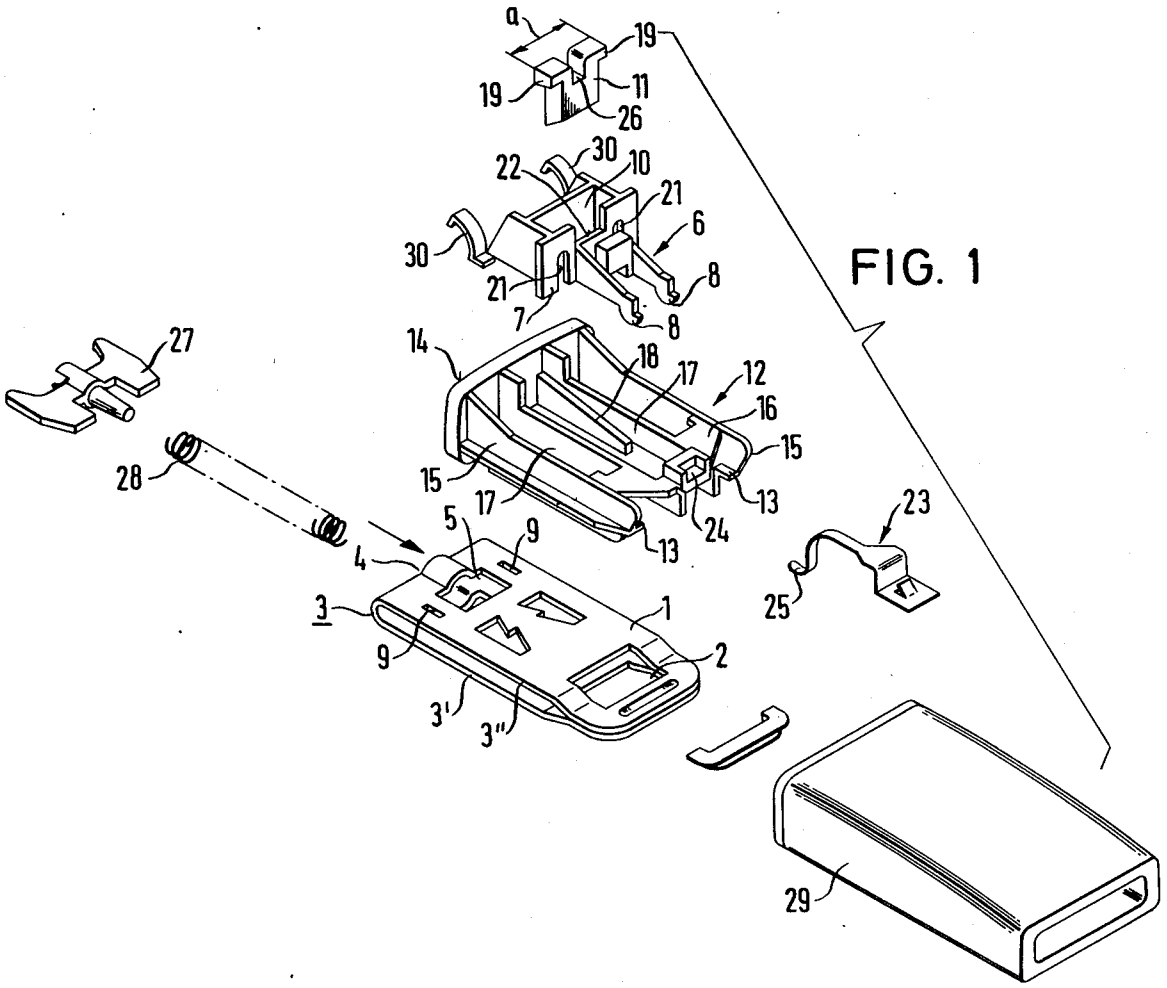
FIG. 1 shows an exploded illustration of the belt lock.
Figure 2:
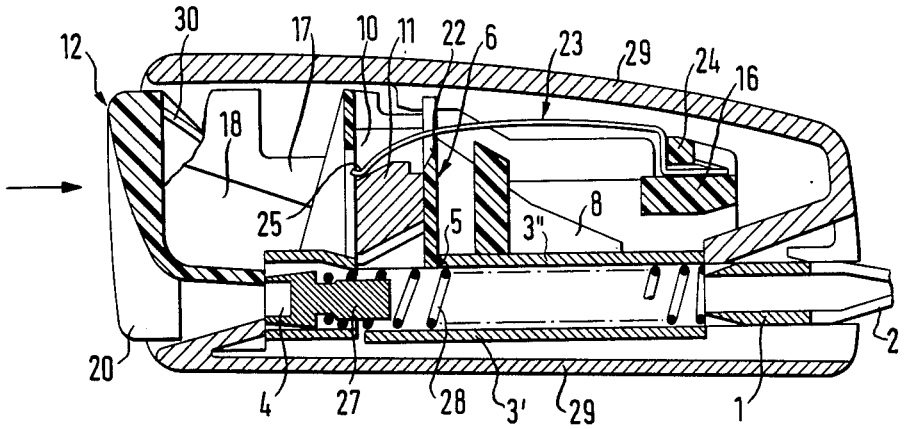
FIGS. 2 and 6 show side sections of the belt lock according to FIG. 1, in an unactuated rest position (FIG. 2) and after inserting the insertion tongue (FIG. 6).

FIGS. 1 and 2 show clearly the construction of the belt lock. Here the stable base for the belt lock is a metal plate 1, bent in U shape, which at the open end has openings 2, for fastening to a free belt band end, or to a fitting, fastened to the floor of the vehicle, for example. These free plate ends are bent together and lie one on the other. On the non-free leg 3 of the plate, is an insertion opening 4 for a belt band tongue, designed in a manner known per se and not further represented, for which the two plate parts 3' and 3'', in connection with the insertion opening 4, form an insertion path. In the plate 1, bar openings 5 are present for the insertion of a bar, described below, transverse to the insertion path (arrow direction). Attachable to the plate part 3'' is a bar guide 6, designed as an injection molded plastic part, which can be fastened, for example, by means of added parts 7 and 8, into openings, (9, for example) of the plate part 3''. The bar guide 6 has a guide channel 10, passing through it, in which a metal bar 11 is movable, transverse to the insertion path. Marked 12, in general, is a pressure key, also designed as an injection molded plastic part, which is supported, movable parallel with the insertion path, on the plate part 3'' and on the bar guide. For this the pressure key 12 has on the lower edges of the side limits, slide cheeks 13, drawn inward, and perpendicular thereto, a pressure surface 14. The pressure key is given its stability of form through the side cheeks 15, and through a connection stay 16 between these cheeks. Between the side cheeks 15 are guide cheeks 17, of which the distance apart corresponds approximately to the width a of a bar 11. On the inner sides of these guide cheeks 17 are lift surfaces 18, inclined diagonal, of which only one can be seen in FIG. 1. The bar 11 cooperates with these lift surfaces 18 by addition-like projections 19, which have diagonal sliding surfaces which, with movement of the pressure key in the arrow direction, run up on the lift surfaces 18 and slide on them to carry out the lifting of the bar. The pressure key 12, which is provided at the front with an insertion opening 20, slides, by its guide cheeks 17 in slot-like openings 21 of the bar guide 6. The bar guide has also a rigid run-up edge 22, formed in one piece with the bar guide, which, as will be described below, cooperates with a spring 23, in arc or sickle form. This spring 23 is fastened by one free end to a block-type bearing point 24 of the pressure key 12, for example, by welding with the plastic material. From this bearing point 24, the spring 23 extends in sickel form over the run-up (transition) edge 22, as shown, in particular, by FIG. 2, and is supported by the free end, against the bar 11, and namely in a groove-like opening 26. This spring 23 presses the bar 11, with release of the pressure key 12, into the locking position, in which the bar 11 projects into the insertion path, and locks the inserted tongue in a manner known per se. FIG. 2 shows the position of the belt lock in which the insertion tongue is not inserted, and in which the bar 11 is supported against an ejector 27, movable along the insertion path, and thus is held in the open position. With insertion of the insertion tongue, the ejector is pressed backward along the insertion path, against the force of the spring 28, until the spring-weighted bar 11 is set free and falls into a coresponding opening in the insetion tongue and locks the latter. If the insertion tongue is to be unlocked, the pressure key 12 is pushed in the arrow direction opposite the plate 1 and opposite the bar guide 6, together with the spring 23. After a certain lift, the greatly curved free end of the spring 23 runs up on the run-up (transition) edge 22 and is relieved or slightly raised, by the bar 11, still not lifted. FIG. 2 shows also that the parts explained are surrounded by a shell-like housing 29, which also forms a part of the inertion opening. As FIG. 1, in particular, shows, on both sides of the bar guide 6 are two springs 30, also sickle-form, formed in one piece with the bar guide, which are supported against the inner side of the pressure surface 14 of the pressure key 12, and which provide, after the depression of the pressure key, for returning it again to the original position.

Figure 6:
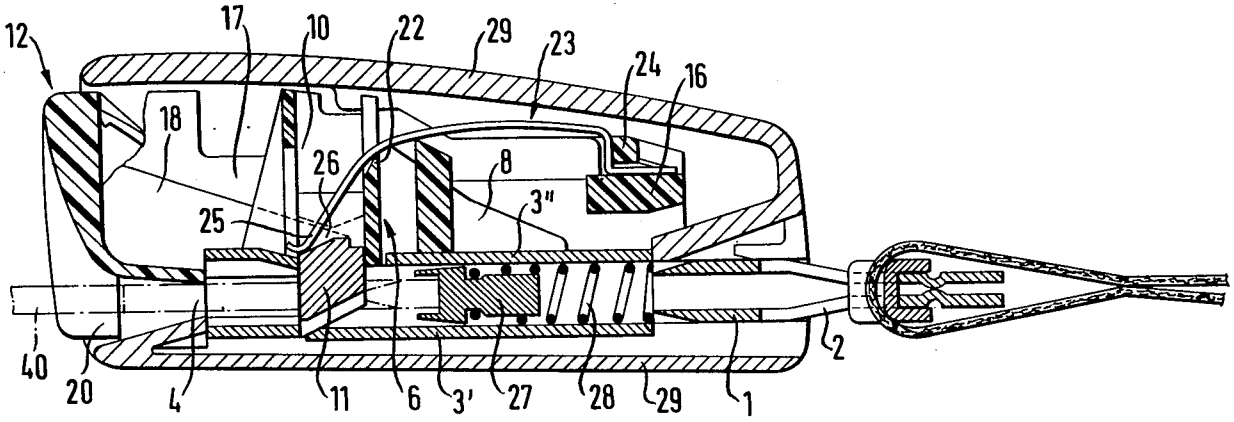

FIG. 6 agrees mainly with FIG. 1, except that here the position is changed in which the one insertion tongue 40 is inserted into the insertion opening 4 and locked by the bar 11. With this, the ejector 27 has been pressed back, against the force of the spring 23, and preclamped. Through the force of the spring 23, the bar 11, movable transverse to the insertion path, has been pressed downward in FIG. 6, into a corresponding catch opening of the insertion tongue 40, by which a locking takes place between the bar 11 and the insertion tongue 40. Here, the free end 25 of the spring is supported on the upper side of the bar 11 and holds the bar 11 in the locked position. In this position, the spring 23 just touches the run-up edge 22, or a slight gap still exists between the run-up edge 22 and the spring 23.

Figure 3A:
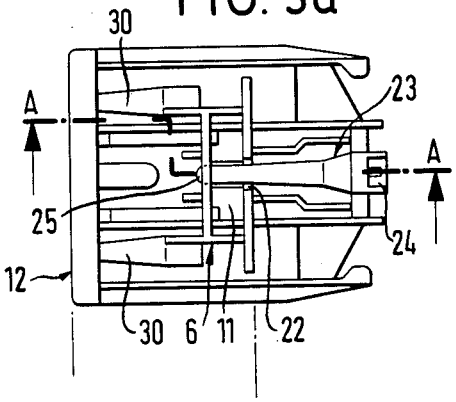
Figure 3B:
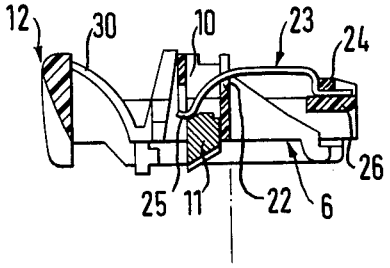
Figure 4A:
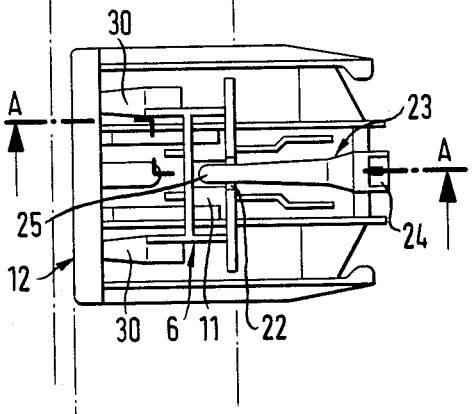
Figure 4B:
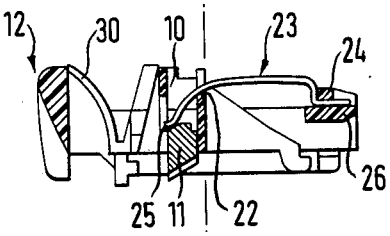
Figure 5A:
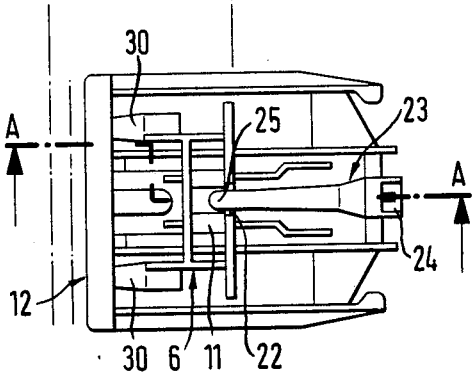
Figure 5B:
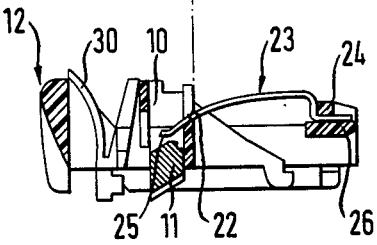

In FIGS. 3*a*, 3*b* to 5*a*, 5*b*, the mode of operation of the belt lock described is illustrated, as to the parts essential to the invention. In each case, top views are compared with section diagrams aong the line A—A. The section views show only the parts essential to understanding, namely, the pressure key 12 with spring 23 and the guide channel 10 with bar 11. In all these figures, the bar 11 is in the locking position according to FIG. 6, and the cooperation of the spring 23 and the bar 11 is shown in different lift positions of the pressure key 12. For this purpose, in all these figures, the plate, as well as the bar guide 6 or bar channel 10 are represented as stationary; that is, always in the same position, while the pressure key is shown in different lift positions. This is made clear by dot-and-dash lines. In FIGS. 3*a* and 3*b*, the pressure key 12 is in the rest position, in which it is pressed by the springs 30. This corresponds to the representation in FIG. 6. Here, the free end 25 of the spring 23 is supported fully on the bar 11 and there is a distance between this spring 25 and the run-up edge 22. By carrying out a slight lift, for example, 2 mm on the pressure key 12, according to FIGS. 4*a* and 4*b*, the spring 23 just (barely) runs up on the run-up edge 22, but is still supported, with a certain pressure, on the bar 11. On further pushing of the pressure key 12 into the lift position according to FIGS. 5*a* and 5*b*, the spring 23, moved with the pressure key 12, has been pushed to the right, in the figures, while with further running up of the spring 23 on the run-up edge 22, the end 25 of the spring is lifted off from the bar 11, with which the bar 11 is released. Now, from this position, after the ejection of the insertion tongue 40, the bar 11, and then the spring 23, are raised and moved into the opening position.

I claim:

1. In a buckle fastener for a safety belt comprising a housing having a guiding channel for guiding a tongue into and from said housing, a latching member movable transversely to said insertion channel for selective engagement and disengagement with a recess formed in the tongue, a leaf spring member biasing said latching member into engagement with the recess in the tongue, and a pressure key slidably guided in said housing in a direction parallel to said guiding channel, said pressure key being provided with ramp means engaging said latching member for pushing said latching member out of engagement with the recess in the tongue when said pressure key is depressed, the improvement wherein said leaf spring has one end secured to said pressure key and its opposed free end bearing on said latching member, said leaf spring moving simultaneously with said pressure key when it is depressed, an abutment member connected with said housing and having an edge extending transversely relative to said leaf spring and being positioned in such a manner in relation to said leaf spring that, upon partial depression of said pressure key, an intermediate portion of said leaf spring abuts against said edge and upon further depression of said pressure key said free end of said leaf spring is lifted off said latching member.

2. A buckle according to claim 1, wherein the spring is bent in an arcuate configuration and curves over said abutment member.

3. A buckle according to claim 1 wherein said abutment member is part of a guide for said latching member.

4. A seat belt buckle comprising a base having an opening into which a tongue is insertable, a latch member movable between an engaged position blocking withdrawal of the tongue from said buckle and a release position in which said latch member is ineffective to block withdrawal of the tongue from said buckle, a slide member movable along said base from an extended position to a retracted position to move said latch member to the release position, a leaf spring having a first end portion connected to said slide member for movement therewith and a second end portion which engages said latch member and applies a biasing force to said latch member urging said latch member toward the engaged position when said slide member is in the extended position, said second end portion of said leaf spring being spaced from said latch member during at least a portion of the movement of said slide mebmer from the extended position to the retracted position to eliminate the biasing force urging said latch member toward the engaged position.

5. A buckle as set forth in claim 4 further including ejector means for moving the tongue in the direction of withdrawal of the tongue from said buckle during movement of said slide member from the extended position to the retracted position, said ejector means including surface means for holding said latch member in engagement with the second end portion of said leaf spring when said slide member is in the extended position with the tongue withdrawn from said buckle.

6. A buckle as set forth in claim 4 further including surface means connected with said base for applying force to said leaf spring to move said second end portion of said leaf spring out of engagement with said latch member during movement of said slide member relative to said base.

* * * * *